US011521563B2

(12) United States Patent
Ge et al.

(10) Patent No.: US 11,521,563 B2
(45) Date of Patent: Dec. 6, 2022

(54) TECHNIQUES TO COMPENSATE FOR FLICKER AT LOW REFRESH RATES

(71) Applicant: Apple Inc., Cupertino, CA (US)

(72) Inventors: Zhibing Ge, Los Altos, CA (US); Chengrui Le, San Jose, CA (US); Yuechen Wu, San Jose, CA (US); Xiaokai Li, Mountain View, CA (US); Lingyu Hong, Princeton Junction, NJ (US); Chaohao Wang, Sunnyvale, CA (US); Shih-Chyuan Fan Jiang, San Jose, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 17/223,903

(22) Filed: Apr. 6, 2021

(65) Prior Publication Data

US 2021/0350752 A1 Nov. 11, 2021

Related U.S. Application Data

(60) Provisional application No. 63/021,009, filed on May 6, 2020.

(51) Int. Cl.
*G09G 3/34* (2006.01)
*G09G 3/36* (2006.01)

(52) U.S. Cl.
CPC ..... *G09G 3/3406* (2013.01); *G09G 3/3648* (2013.01); *G09G 2310/027* (2013.01); *G09G 2310/06* (2013.01); *G09G 2310/08* (2013.01); *G09G 2320/0247* (2013.01); *G09G 2320/041* (2013.01); *G09G 2320/062* (2013.01);
(Continued)

(58) Field of Classification Search
CPC ..... G09G 3/3406–3426; G09G 3/36–3696; G09G 2310/06; G09G 2310/08; G09G 2320/0247; G09G 2320/041; G09G 2320/062; G09G 2340/0435; G09G 2360/16
See application file for complete search history.

(56) References Cited

U.S. PATENT DOCUMENTS 9,495,896 B2 * 11/2016 Liu ..... G09G 3/2007
10,210,815 B2 * 2/2019 Oh ..... G09G 3/3406
11,030,962 B2 * 6/2021 Lee ..... G09G 3/3648
(Continued)

*Primary Examiner* — Gene W Lee
(74) *Attorney, Agent, or Firm* — Kilpatrick, Townsend and Stockton LLP

(57) ABSTRACT

Certain embodiments are directed to techniques (e.g., a method, an apparatus, and non-transitory computer readable medium storing code or instructions executable by one or more processors) for mitigating the flicker on the displays at low driving frequencies due to drops of the voltage holding ratio of the materials for the display. The techniques to compensate for flicker in a liquid crystal display can include generating a dynamic waveform for the backlight of the display. The dynamic waveform can be synchronized with the driving rate of the liquid crystal display such that the luminosity of the backlight increases during periods when the voltage-holding ratio drops in the materials of the display. In this way, a liquid crystal material can be utilized in a display to generate reduced power consumption with liquid crystal rate minimizing the flicker in response to the drops of the voltage-holding ratio.

17 Claims, 5 Drawing Sheets

(52) U.S. Cl.
CPC ..... *G09G 2340/0435* (2013.01); *G09G 2360/145* (2013.01); *G09G 2360/16* (2013.01)

(56) References Cited

U.S. PATENT DOCUMENTS

| | | | | |
|---|---|---|---|---|
| 2012/0182332 | A1* | 7/2012 | Liu | G09G 3/2007 345/691 |
| 2016/0050402 | A1* | 2/2016 | Jeong | H04N 9/69 348/674 |
| 2017/0124962 | A1* | 5/2017 | Oh | G09G 3/3648 |
| 2020/0211481 | A1* | 7/2020 | Lee | G09G 3/3648 |

* cited by examiner

TECHNIQUES TO COMPENSATE FOR FLICKER AT LOW REFRESH RATES

CROSS-REFERENCES TO RELATED APPLICATIONS

This application claims the benefit of U.S. Provisional Patent Application No. 63/021,009, entitled "Techniques To Compensate For Flicker At Low Refresh Rates," filed May 6, 2020, hereby incorporated by reference in its entirety and for all purposes.

BACKGROUND

The power consumption of a Liquid Crystal Displays (LCD) is directly related to the driving frequency of the display. While lower driving frequencies can reduce power consumption, operations of displays, especially those incorporating new liquid crystal materials, can result in flicker of images on the display at the lower driving frequencies due to drops in voltage holding ratio. This flicker in the display is undesirable and can result in a poor user experience.

BRIEF SUMMARY

Certain embodiments are directed to techniques (e.g., a method, an apparatus, and non-transitory computer readable medium storing code or instructions executable by one or more processors) for mitigating flicker on the displays at low driving frequencies due to drops of the voltage holding ratio of the materials of the display.

A display can include several components including a case, a backlight, one or more polarized filters, a liquid crystal layer, one or more color filters, and cover glass. As liquid crystal displays do not produce light by themselves, they require illumination to produce visible light. Backlights illuminate the LCD from the side and/or the back of the display panel.

Traditionally, the backlight is maintained at a constant level of illumination. However, one method to overcome the flicker issue at low driving frequency is to generate a dynamic waveform for the backlight of the liquid crystal display to compensate for the flicker. The dynamic waveform can vary the illumination level of the backlight for the liquid crystal display by a predetermined luminosity at a predetermined frequency. The technique also includes synchronizing a timing of the dynamic waveform for the backlight and the driving rate of the liquid crystal display such that the dynamic waveform for the backlight and the driving rate of the liquid crystal display start simultaneously. The technique can include illuminating the backlight according to the dynamic waveform in synch with the driving rate of the liquid crystal display.

In one aspect of the disclosure provides a method of compensating for flicker in a liquid crystal display performed by one or more processors for a poor flicker liquid crystal display. The method can include detecting operation of the liquid crystal display at a driving rate in a low frequency range. The operation in the low frequency range can result in flicker of one or more images of the liquid crystal display. The method can include generating a dynamic waveform for a backlight of the liquid crystal display to compensate for the flicker for the liquid crystal display. The dynamic waveform can include varying illumination level of the backlight for the liquid crystal display by a predetermined luminosity at a predetermined frequency. The method can include synchronizing a timing of the dynamic waveform for the backlight and the driving rate of the liquid crystal display such that the dynamic waveform for the backlight and the driving rate of the liquid crystal display start simultaneously. The method can include illuminating the backlight according to the dynamic waveform in synch with the driving rate of the liquid crystal display.

In various embodiments, the method can include detecting a grey level of one or more frames of an image received from a video source. The method can include calculating an average grey level of the one or more frames of an image. The method can include accessing a table stored in a memory of the liquid crystal display to determine the predetermined luminosity of the dynamic waveform based at least in part on the calculated average grey level of the one or more frames of the image from the video source.

In various embodiments, the method can include detecting a grey level of a portion of one or more frames of an image received from a video source. The method can include calculating an average grey level of the portion of the one or more frames of an image. The method can include accessing a table stored in a memory of the liquid crystal display to determine the predetermined luminosity of the dynamic waveform based at least in part on the calculated average grey level of the portion of the one or more frames of the image from a video source.

In various embodiments, the method can include measuring a temperature of the liquid crystal display. The method can include accessing a table stored in a memory of the liquid crystal display to determine the predetermined luminosity of the dynamic waveform based at least in part on the measured temperature of the liquid crystal display. In various embodiments, the low frequency range is between 0.01 and 59.9 Hertz. The predetermined frequency can be a frequency over 120 Hertz. The one or more processors of the liquid crystal display can receive a synchronization signal from a display driver.

In one aspect, the disclosure describes a poor flicker liquid crystal display. The display can include a programmable backlight capable of varying luminosity of the backlight based at least in part on a timing signal. The display can include a memory to store one or more instructions. The display can include one or more processors to perform operations. The operations can include detecting operation of the liquid crystal display at a driving rate in a low frequency range, the operation in the low frequency range resulting in flicker of one or more images of the liquid crystal display. The operations can include generating a dynamic waveform for a backlight of the liquid crystal display to compensate for the flicker for the liquid crystal display, the dynamic waveform varying illumination level of the backlight for the liquid crystal display by a predetermined luminosity at a predetermined frequency. The operations can include synchronizing a timing of the dynamic waveform for the backlight and the driving rate of the liquid crystal display such that the dynamic waveform for the backlight and the driving rate of the liquid crystal display start simultaneously. The operations can include illuminating the backlight according to the dynamic waveform in synch with the driving rate of the liquid crystal display.

In some embodiments, the operations further include detecting a grey level of one or more frames of an image received from a video source. The operations can include calculating an average grey level of the one or more frames of an image. The operations can include accessing a table stored in a memory of the liquid crystal display to determine the predetermined luminosity of the dynamic waveform based at least in part on the calculated average grey level of the one or more frames of the image from the video source.

In some embodiments, the operations further include detecting a grey level of a portion of one or more frames of an image received from a video source. The operations can include calculating an average grey level of the portion of the one or more frames of an image. The operations can include accessing a table stored in a memory of the liquid crystal display to determine the predetermined luminosity of the dynamic waveform based at least in part on the calculated average grey level of the portion of the one or more frames of the image from a video source.

The operations can further include measuring a temperature of the liquid crystal display. The operations can further include accessing a table stored in a memory of the liquid crystal display to determine the predetermined luminosity of the dynamic waveform based at least in part on the measured temperature of the liquid crystal display. The low frequency range can be between 0.01 and 59.9 Hertz. The predetermined frequency can be over 120 Hertz. The some embodiments, the one or more processors of the liquid crystal display receive a synchronization signal from a display driver.

In one aspect, the disclosure provides a non-transitory computer-readable storage medium, including instructions configured to cause one or more processors of a display to perform operations. The operations can include detecting operation of the liquid crystal display at a driving rate in a low frequency range, the operation in the low frequency range resulting in flicker of one or more images of the liquid crystal display. The operations can include generating a dynamic waveform for a backlight of the liquid crystal display to compensate for the flicker for the liquid crystal display, the dynamic waveform varying illumination level of the backlight for the liquid crystal display by a predetermined luminosity at a predetermined frequency. The operations can include synchronizing a timing of the dynamic waveform for the backlight and the driving rate of the liquid crystal display such that the dynamic waveform for the backlight and the driving rate of the liquid crystal display start simultaneously. The operations can include illuminating the backlight according to the dynamic waveform in synch with the driving rate of the liquid crystal display.

In some embodiments, the operations can include detecting a grey level of one or more frames of an image received from a video source. The operations can include calculating an average grey level of the one or more frames of an image. The operations can include accessing a table stored in a memory of the liquid crystal display to determine the predetermined luminosity of the dynamic waveform based at least in part on the calculated average grey level of the one or more frames of the image from the video source.

In some embodiments, the operations can include detecting a grey level of a portion of one or more frames of an image received from a video source. The operations can include calculating an average grey level of the portion of the one or more frames of an image. The operations can include accessing a table stored in a memory of the liquid crystal display to determine the predetermined luminosity of the dynamic waveform based at least in part on the calculated average grey level of the portion of the one or more frames of the image from a video source.

In some embodiments, the operations can include measuring a temperature of the liquid crystal display. The operations can include accessing a table stored in a memory of the liquid crystal display to determine the predetermined luminosity of the dynamic waveform based at least in part on the measured temperature of the liquid crystal display. The low frequency range can be between 0.01 and 59.9 Hertz. The predetermined frequency can be over 120 Hertz.

These and other embodiments of the invention are described in detail below. For example, other embodiments are directed to systems, devices, and computer readable media associated with methods described herein.

A better understanding of the nature and advantages of embodiments of the present invention may be gained with reference to the following detailed description and the accompanying drawings.

DETAILED DESCRIPTION

Figure 1:
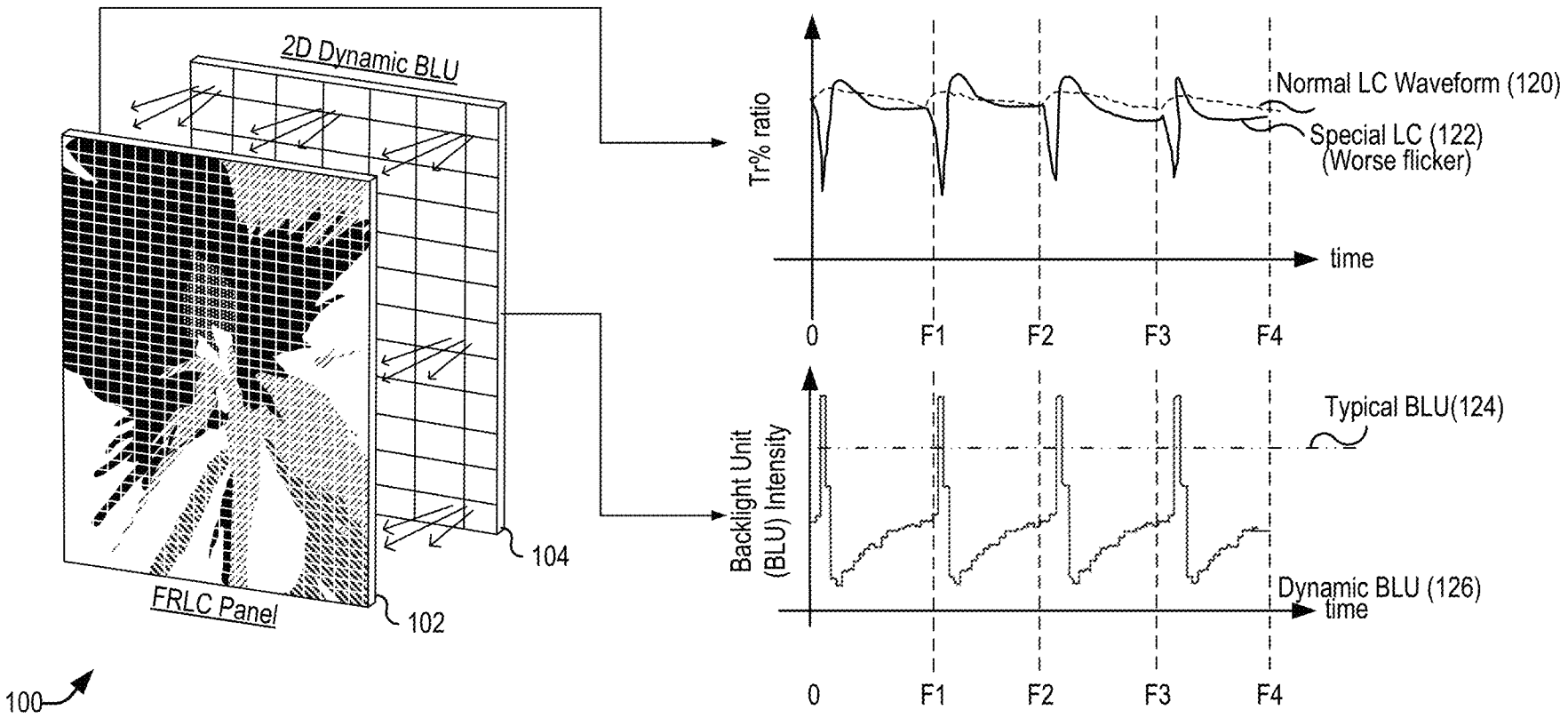
FIG. 1 illustrated components of a display, a transparency ratio percentage for two different liquid crystal materials, and variation of backlight intensity.

Certain embodiments are directed to techniques (e.g., a method, an apparatus, and non-transitory computer readable medium storing code or instructions executable by one or more processors) for mitigating the flicker on the displays at low driving frequencies due to drops of the voltage holding ratio of the materials for the display. The techniques to compensate for flicker in a liquid crystal display can include generating a dynamic waveform for the backlight of the display. The dynamic waveform can be synchronized with the driving rate of the liquid crystal display such that the luminosity of the backlight increases during periods with the drops of the voltage-holding ratio of the materials for the display. In this way, a liquid crystal material can be utilized in a display to generate reduced power consumption with liquid crystal rate minimizing the flicker in response to the drops of the voltage-holding ratio.

One characteristic of LCD panels is the response time of the display. Response time is the time it takes the pixels of the display to shift from one color to another. Usually, this is measured in terms of going from black to white and back to black again, in terms of milliseconds. A typical LCD response time is under ten milliseconds (ms), with some being as fast as one millisecond.

The exact method of measuring this statistic is not standardized. Some manufacturers express it in terms of an LCD's panel going black to white, or black to white to black, or more commonly "grey to grey." That means going through the same full spectrum, but starting and ending on finer, more difficult grey values. In all cases, lower response times are better, because they cut down on image issues like blurring or "ghosting."

Response time is different than a display's refresh rate. The terms sound similar, but the refresh rate is the number of times a screen displays a new image every second, expressed in Hertz. Most monitors use a 60-Hertz refresh rate, though some go higher—and higher is better. In contrast, for response time, lower response times are better.

Most computer users will not even be aware of the response time for their display, because most of the time it does not matter. For web surfing, writing an email or word processing, or editing photos, the delay between your screen shifting colors is so fast that a user will not notice it. Even video, on modern computer monitors and televisions, usually does not have a delay significant enough for a viewer to notice.

Gaming applications can be the exception. For gamers, every single millisecond counts—the difference between winning and losing a fighting match, landing a long-range sniper shot, or even getting that perfect line in a racing game can indeed be a single millisecond. So for gamers who are looking for every possible competitive edge, a low refresh rate between 1 and 5 milliseconds can be worth the expense of a more expensive, gaming-focused monitor.

Current displays generally have response times between 9 to 13 milliseconds. Displays currently being developed have reduced response times between 3 and 6 milliseconds. The new liquid crystal displays (nLC) and polymer liquid crystal displays (pLC) can operate at higher refresh rates. Current displays can operate along a first refresh rate line 102 of 60 Hz. Some current displays operate at a second refresh rate line 104 of 120 Hz. New display designs can operate along a third refresh rate line of 106. The higher refresh rates can also decrease the blur width index resulting in smoother displayed images.

Low refresh rates can have a significant effect on power consumption for the display. In a first example, the power consumption for a 60 Hz display can be around 786 milliWatts (mW). In a second example for displays that operate between 60 Hz and 120 Hz, the power consumption can be as high as 908 mW. But if the display is operated between 120 Hz to as low as 24 Hz, as shown in a third example, the power consumption can be reduced by 20% (from the second category) to as low as 732 mW. Further reducing the refresh rate to operate between 120 Hz and 1 Hz, as shown in a forth example, only results in a 6% drop in power consumption (as compared with the third category). Therefore, reducing the refresh rate can significantly reduce the power consumption of the display. However, operation of the display at these low refresh rates can result in other issues, specifically display flicker.

FIG. 1 illustrates selected components of a display 100. In various embodiments, the display 100 can include a liquid crystal layer 102 and a backlight 104. In various embodiments, the display can also include a case, a polarized filter, a thin-film-transistor layer, a color filter, a polarized filter, and cover glass. Liquid crystal display technology works by blocking light. Specifically, an LCD can be made of two pieces of polarized glass (also called substrate), shown as polarized filters that can contain a liquid crystal layer 102 between them. A backlight 104 creates light that passes through the first substrate. At the same time, electrical currents cause the liquid crystal molecules to align to allow varying levels of light to pass through to the second substrate and create the colors and images that can be seen. Most LCD displays use active matrix technology. A thin film transistor (TFT) layer arranges tiny transistors and capacitors in a matrix on the glass of the display. To address a particular pixel, the proper row is switched on, and then a charge is sent down the correct column. Since all of the other rows that the column intersects are turned off, only the capacitor at the designated pixel receives a charge. The capacitor is able to hold the charge until the next refresh cycle. The cover glass can protect the various layers from damage. The case can hold the various layers of the display together.

Voltage Holding Ratio (VHR) is a critical electrical parameter for liquid crystal displays (LCDs). VHR is a measure of the LCD's ability to retain a voltage during the time between pixel updates (frame time). The voltage-holding ratio of a liquid crystal material can be affected by temperature of the display materials. The voltage-holding ratio of a material can also be affected by a grey level of the images projected on the display. The grey level or grey value indicates the brightness of a pixel. The minimum grey level is 0. The maximum grey level depends on the digitization depth of the image. For an 8-bit-deep image it is 255. The display may slowly recover from images sticking when it is driven with a homogeneous grey scale for a long period of time.

FIG. 1 illustrates a transparency ratio percentage for two different materials over time. A first plot 120 illustrated the transparency ratio for a first liquid crystal (LC) display material. Typically a backlight has constant light intensity. A first backlight intensity plot 124 is depicted. As shown, the first material only has minor variations in the transparency ratio over time. However, a second plot 122 of a second liquid crystal (LC) display material with a voltage-holding ratio with a decreased ability to retain voltage as compared with the first material. Because of the reduced voltage-holding ratio, the second plot 122 shows periodic, significant drops in the transparency ratio percentage over time. To compensate, for these changes in voltage holding ratio over time, a dynamic backlight can be used. The dynamic backlight can construct a waveform that increases during periods when the voltage holding ratio of the material drops, therefore reducing any flicker. A second backlight intensity plot 126 is shown. The second backlight intensity plot 126 is synchronized to match the drops in the transparency percentage ratio of the second material.

Figure 2:
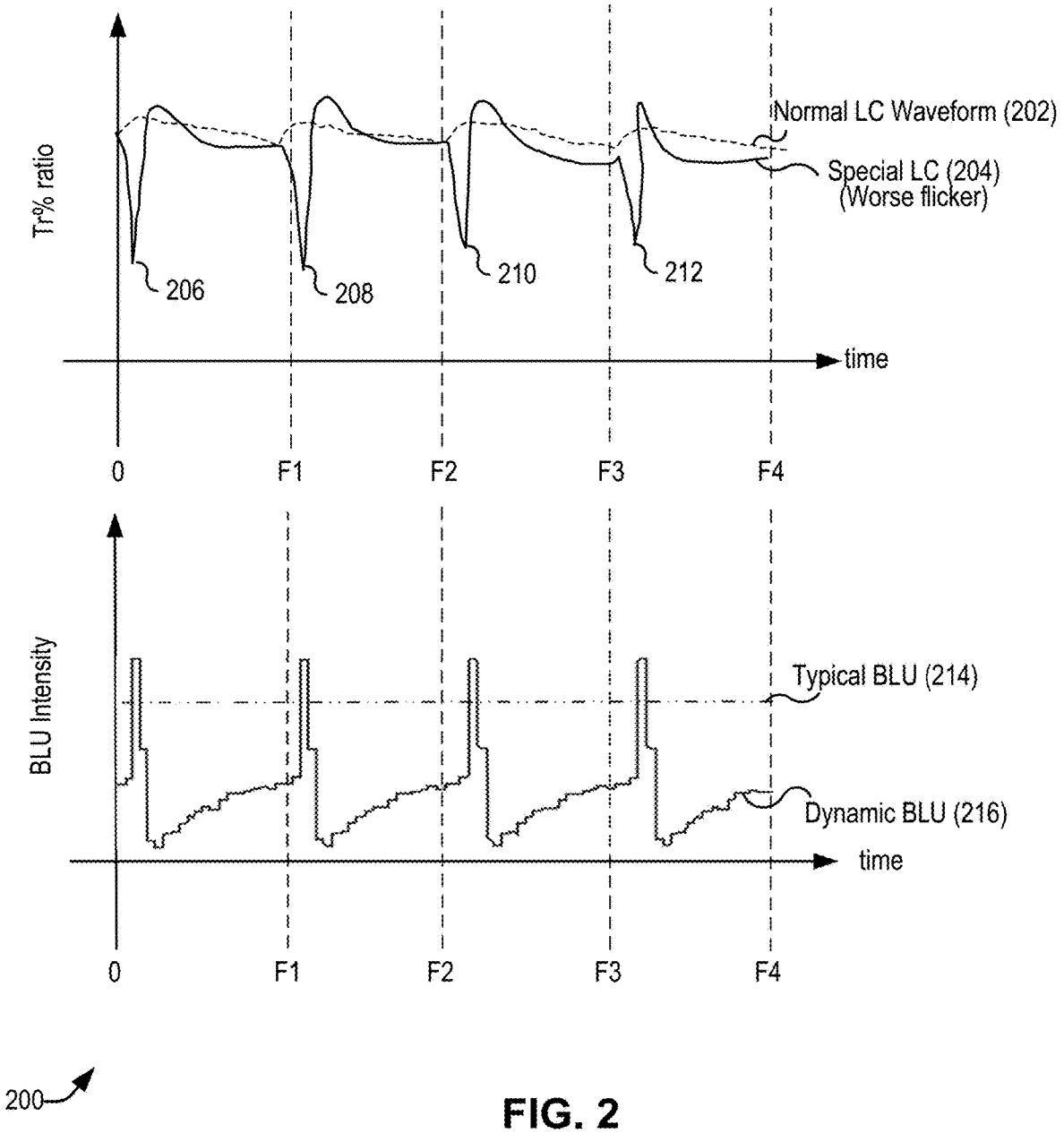
FIG. 2 illustrates a plot of liquid crystal relative luminosity and backlight compensation waveform over time.

FIG. 2 illustrates a graph of relative luminosity over time for two different displays, specifically a first display with a 12-millisecond response time. A second display incorporates a liquid crystal material with a 5-millisecond response time. A first line 202 illustrates the response of the first display over time. A second line 204 illustrates the response of the second display over time. As previously discussed, the liquid crystal display has issues with display flicker. Flicker is a visible change in brightness between cycles displayed on video displays. As shown in FIG. 2, the second display illustrates flicker at the luminosity troughs 206, 208, 210, and 212 due to significant drops in luminosity at regular intervals. The first display may have slight reductions in luminosity over time but the drop is not as significant as the second display and these reductions may not be perceivable by the unaided human eye. FIG. 2 also illustrates a first backlight compensation waveform 214 over time. For the first display the luminosity is constant. A second backlight compensation waveform 216 illustrates a dynamic backlight waveform that varies over time in order to compensate for the drop in luminosity with the liquid crystal display. As shown in FIG. 2, the compensation waveform 216 is synchronized with the drops in luminosity for the second display at the luminosity troughs 206, 208, 210, and 212.

Figure 3:
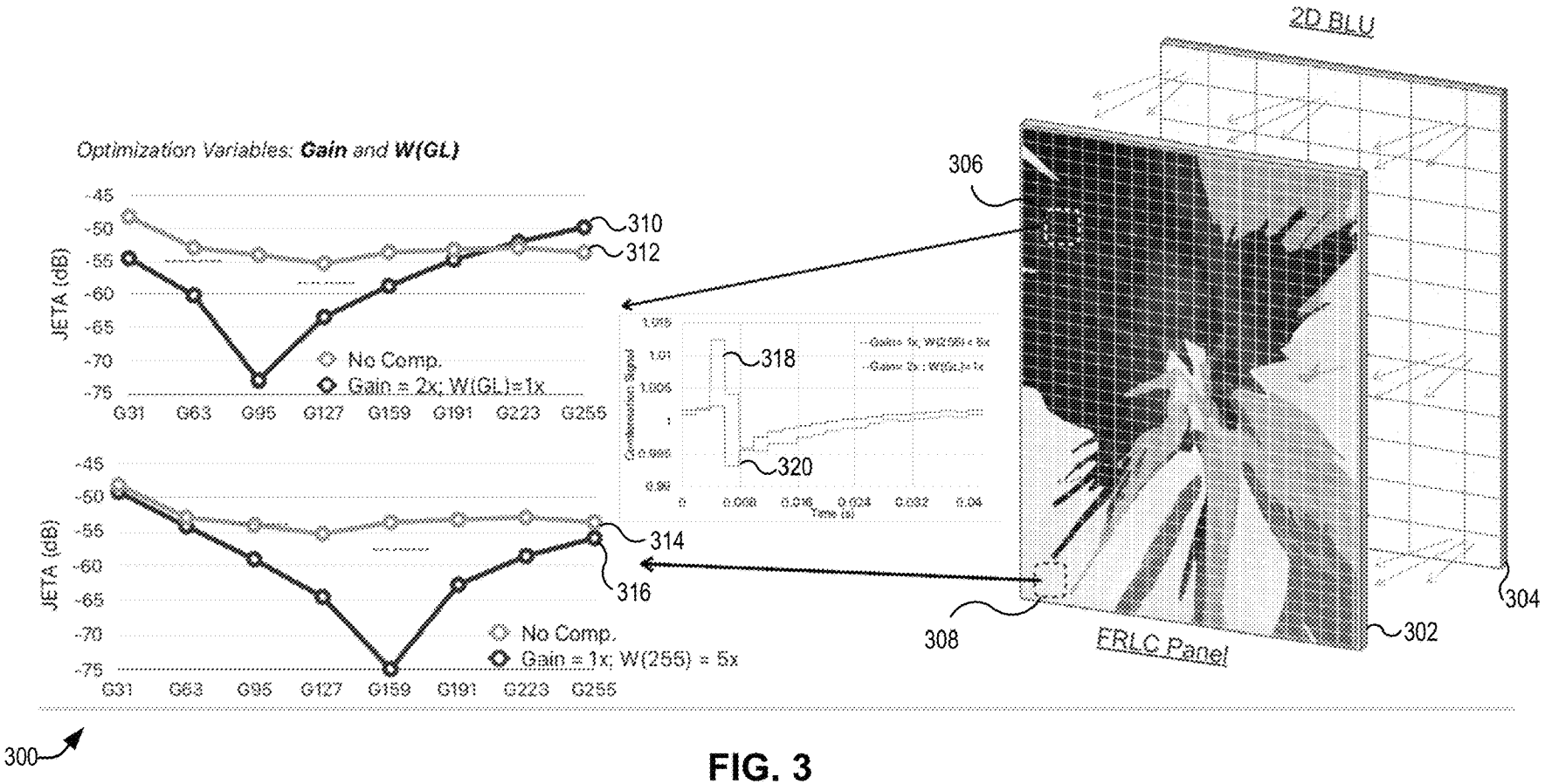
FIG. 3 illustrates a method of calculating grey-level for a display.

FIG. 3 illustrates a method of calculating grey-level for a display. As previously discussed, the voltage holding ratio drop is both temperature dependent and grey level dependent. Therefore, the techniques can determine the grey level of the images to be presented on the display. Grey levels can be calculated as an average grey level of one or more frames of the display images. In some embodiments, the grey level can be detected for a portion of one or more frames of an image received from a video source.

FIG. 3 illustrates a liquid crystal display 302 with a dynamic backlight 304. The grey level can influence the voltage-holding ratio of the display. As the grey level can vary across the image displayed, the voltage-holding ratio can vary across an image on a display. Therefore, to compensate for the flicker of a display with varying voltage holding ratio, the dynamic backlight waveform will need to vary depending on the grey level for the images on the display.

In various embodiments, a compensation algorithm for the dynamic backlight can be calculated with the following algorithm in which the optimized variables are Gain and grey level (GL).

$$\text{Comp} = 1 - \text{Gain} * \frac{1}{N} \sum_{GL=31}^{255} \left[ W(GL) \frac{Lum(GL)}{Lum_{GL}(t)} \right]$$

FIG. 3 illustrates a first area 306 and a second area 308 of the liquid crystal display 302 with different grey levels. The first area 306 has a larger grey level than the second area 308 of the display. As voltage holding ratio is also dependent on temperature, the compensation algorithm can be determined for a temperature or temperature range of the display (e.g., 20 degrees Celsius(C)). Other compensation tables can be determined for different temperatures (e.g., 0 degrees C., 40 degrees C. or 60 degrees C.). In determining a grey level of the display a fast photodetector can be used to determine the grey level.

The minimum grey level is 0. The maximum grey level depends on the digitization depth of the image. For an 8-bit-deep image it is 255. In a binary image a pixel can only take on either the value 0 or the value 255. In contrast, in a greyscale or color image a pixel can take on any value between 0 and 255. In a color image the grey level of each pixel can be calculated using the following formula:

Grey level=0.299*red component+0.587*green component+0.114*blue component

In various techniques, an average grey level can be compensated for the display. In various embodiments, the techniques calculate a grey level of a central portion of the display. The average grey level can be used to generate the compensation waveform. In a first plot 310 of JEITA (db) for various regions of the display (e.g., G 31, G 63, G 95, G 127, G159, G191, G223, and G255) for no compensation in the waveform. In a second plot 312 of JETA (db) for various regions of the display (e.g., G 31, G 63, G 95, G 127, G159, G191, G223, and G255) for using the selective compensation waveform for the backlight. In the second plot it can be seen that the areas with the lower grey levels perform better.

Japan Electronic Information Technology Association (JEITA) standard is a technique to measure flicker of a LCD display using a Fast Fourier Transformation of the signal. The advantages of the JEITA technique is that the method if accurate and well defined. The JEITA method is based on frequency domain calculations. It uses an FFT to determine the AC and DC level of the measured signal and translates the signal into an FFT. The equation for measuring flicker is as follows:

$$Flicker_{JEITA} = 20 \log\left(\frac{\text{AC}}{\text{DC}}\right) + Corr$$

In this equation, AC/DC are the AC/DC components for flicker FFT signal. Corr is a weighting factor to compensate for human eye sensitivity.

In a third plot 314 of JEITA (db) for various regions of the display (e.g., G 31, G 63, G 95, G 127, G159, G191, G223, and G255) for no compensation in the waveform. In a fourth plot 516 of JETA (db) for various regions of the display (e.g., G 31, G 63, G 95, G 127, G159, G191, G223, and G255) for using the selective compensation waveform for the backlight. As can be seen for the fourth plot, the compensation waveform works better for higher grey level areas.

FIG. 3 also shows a first compensation waveform 318 and a second compensation waveform 320. As shown the first compensation waveform 318 differs from the second compensation waveform 320 over time.

The techniques disclosed herein can be used to compensate for flicker in liquid crystal displays. The techniques can be used to compensate for blur in displays. The techniques can be used to reduce flicker in positive liquid crystal displays (p-LC). The techniques can also be employed for very low frequency (1 Hz-10 Hz) liquid crystal displays.

Figure 4:
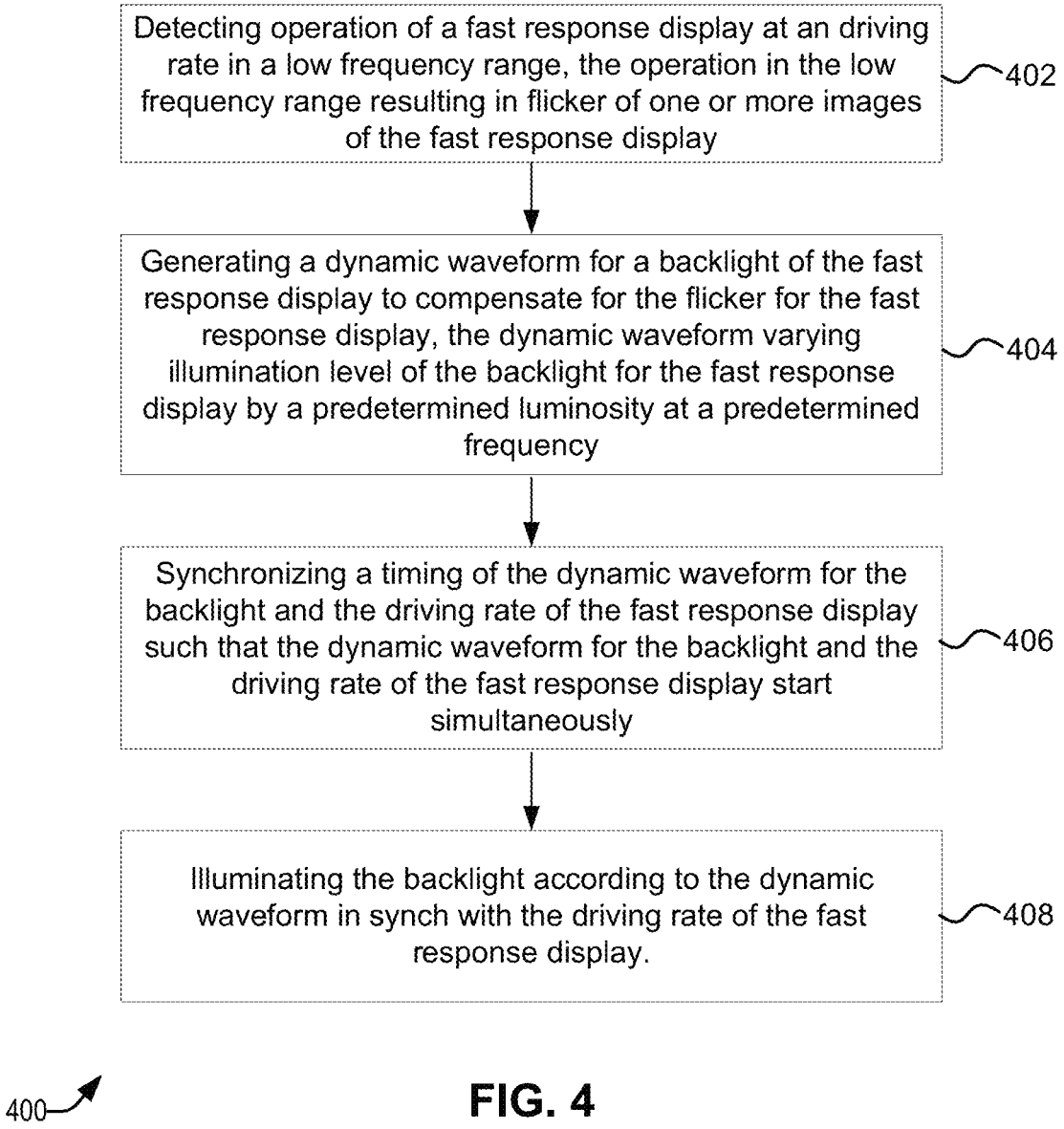
FIG. 4 illustrates a method of compensating for flicker in a liquid crystal liquid crystal display performed by one or more processors for the liquid crystal display.

FIG. 4 illustrates a process 400 for method of compensating for flicker in a liquid crystal liquid crystal display performed by one or more processors for the liquid crystal display. Alternative embodiments may vary in function by combining, separating, or otherwise varying the functionality described in the blocks illustrated in FIG. 4. Elements for performing the functionality of one or more of the blocks illustrated in FIG. 4 may comprise hardware and/or software components of a distributed system including computing devices, storage devices, network infrastructure, and servers illustrated in FIG. 5 and as described below.

At 402, the process 400 can include detecting operation of the liquid crystal display at a driving rate in a low frequency range. The operation in the low frequency range resulting in flicker of one or more images of the liquid crystal display. The processor for the display can detect the driving frequency of the display and can calculate the period drops in the voltage-holding ratio of the display.

At 404, the process 400 can include generating a dynamic waveform for a backlight of the liquid crystal display to compensate for the flicker for the liquid crystal display. The dynamic waveform can vary the illumination level of the backlight for the liquid crystal display by a predetermined luminosity at a predetermined frequency. The luminosity for the backlight can be calculated based at least in part on the calculated drop in voltage holding ratio of display at a given temperature. The predetermined frequency can be based in part on the frequency in drop of the voltage-holding ratio of the display at a given temperature. The dynamic waveform can be store in a memory of the electronic device (e.g., the display).

In various embodiments, the process 400 can include detecting a grey level of one or more frames of an image received from a video source. The process 400 can include calculating an average grey level of the one or more frames of an image. The average grey level can be calculated based at least in part using a fast photodetector. The process 400 can include accessing a table stored in a memory of the liquid crystal display to determine the predetermined luminosity of the dynamic waveform based at least in part on the calculated average grey level of the one or more frames of the image from the video source In various embodiments, the process 400 can include detecting a grey level of a portion of one or more frames of an image received from a video source. The process 400 can include calculating an average grey level of the portion of the one or more frames of an image. The process 400 can include accessing a table stored in a memory of the liquid crystal display to determine the predetermined luminosity of the dynamic waveform based at least in part on the calculated average grey level of the portion of the one or more frames of the image from a video source.

In various embodiments, the process 400 can include measuring a temperature of the liquid crystal display. The process 400 can include accessing a table stored in a memory of the liquid crystal display to determine the predetermined luminosity of the dynamic waveform based at least in part on the measured temperature of the liquid crystal display.

In various embodiments, the low frequency range is between 0.01 and 59.9 Hertz.

In various embodiments, predetermined frequency is over 120 Hertz. In various embodiments the predetermined frequency is 440 Hertz.

At 406, the process 400 can include synchronizing a timing of the dynamic waveform for the backlight and the driving rate of the liquid crystal display such that the dynamic waveform for the backlight and the driving rate of the liquid crystal display start simultaneously. In various embodiments, the display can include an outgoing signal called a resynch signal. The backlight unit can use the resynch signal to ensure the display driving signal and the backlight signal are synchronized.

In various embodiments, the one or more processors of the liquid crystal display receive a synchronization signal from a display driver.

At 408, the process 400 can include illuminating the backlight according to the dynamic waveform in synch with the driving rate of the liquid crystal display.

It should be appreciated that the specific steps illustrated in FIG. 4 provide particular techniques for generating a machine learning application according to various embodiments of the present disclosure. Other sequences of steps may also be performed according to alternative embodiments. For example, alternative embodiments of the present invention may perform the steps outlined above in a different order. Moreover, the individual steps illustrated in FIG. 4 may include multiple sub-steps that may be performed in various sequences as appropriate to the individual step. Furthermore, additional steps may be added or removed depending on the particular applications. One of ordinary skill in the art would recognize many variations, modifications, and alternatives.

I. Example Device

Figure 5:
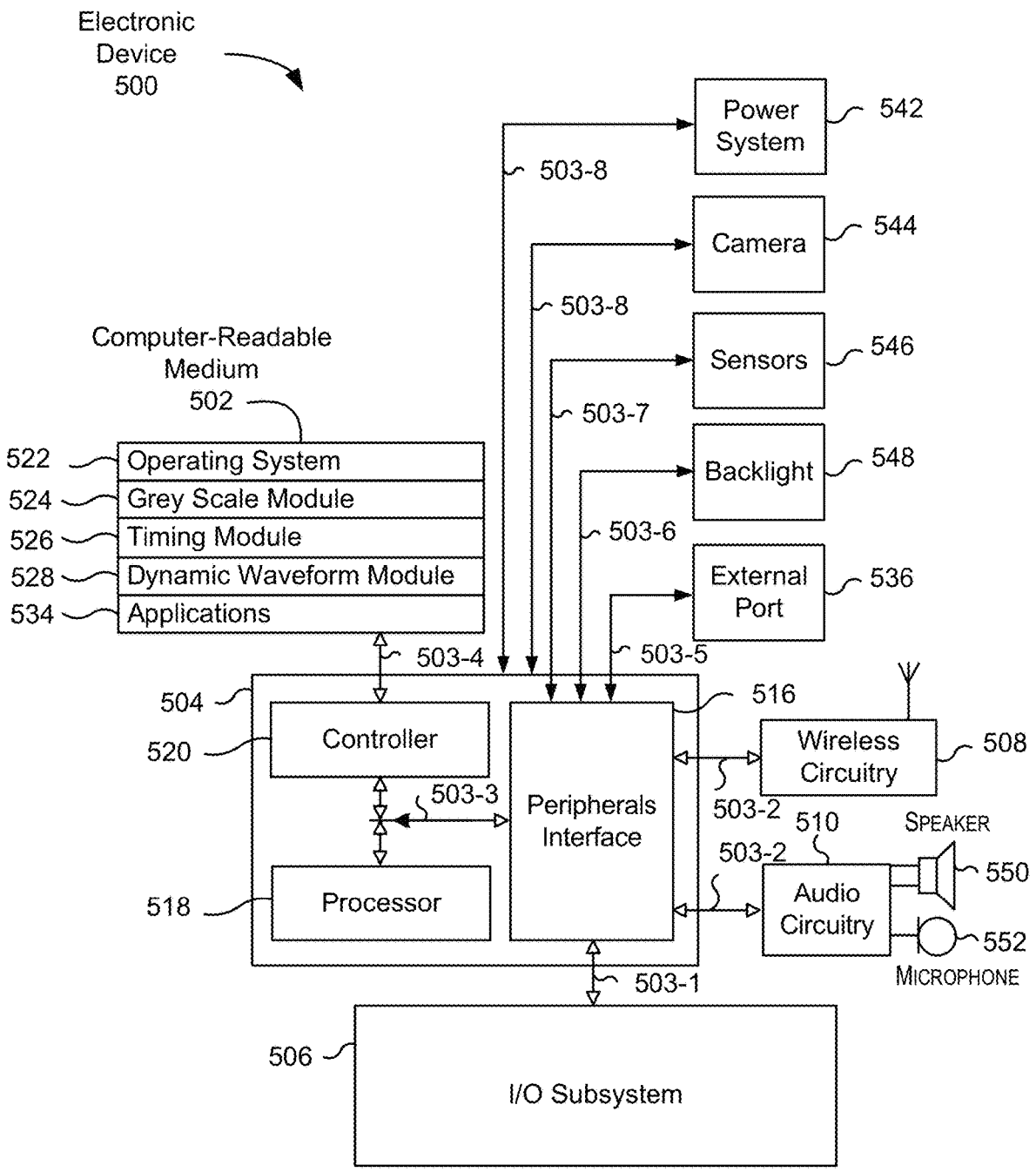
FIG. 5 is block diagram of an example device according to embodiments of the present disclosure.

FIG. 5 is a block diagram of an example electronic device 500. Device 500 can include a computer-readable medium 502, a processing system 504, an Input/output (I/O) subsystem 506, wireless circuitry 508, and audio circuitry 510 including speaker 512. The electronic device can optionally include a microphone 514. These components may be coupled by one or more communication buses or signal lines 503. Device 500 can be a liquid crystal display, any portable electronic device, including a handheld computer, a tablet computer, a mobile phone, laptop computer, tablet device, a media player, a personal digital assistant (PDA), a portable gaming device, or the like, including a combination of two or more of these items.

It should be apparent that the architecture shown in FIG. 5 is only one example of an architecture for device 500, and that device 500 can have more or fewer components than shown, or a different configuration of components. The various components shown in FIG. 5 can be implemented in hardware, software, or a combination of both hardware and software, including one or more signal processing and/or application specific integrated circuits.

Wireless circuitry 508 is used to send and receive information over a wireless link or network to one or more other devices' conventional circuitry such as an antenna system, a radio frequency (RF) transceiver, one or more amplifiers, a tuner, one or more oscillators, a digital signal processor, a coder-decoder (CODEC) chipset, memory, etc. Wireless circuitry 508 can use various protocols, e.g., as described herein. In various embodiments, wireless circuitry 508 is capable of establishing and maintaining communications with other devices using one or more communication protocols, including time division multiple access (TDMA), code division multiple access (CDMA), global system for mobile communications (GSM), Enhanced Data GSM Environment (EDGE), wideband code division multiple access (W-CDMA), Long Term Evolution (LTE), LTE-Advanced, Wi-Fi (such as Institute of Electrical and Electronics Engineers (IEEE) 802.11a, IEEE 802.11b, IEEE 802.11g and/or IEEE 802.11n), Bluetooth, Wi-MAX, Voice Over Internet Protocol (VoIP), near field communication protocol (NFC), a protocol for email, instant messaging, and/or a short message service (SMS), or any other suitable communication protocol, including communication protocols not yet developed as of the filing date of this document.

Wireless circuitry 508 is coupled to processing system 504 via peripherals interface 516. Peripherals interface 516 can include conventional components for establishing and maintaining communication between peripherals and processing system 504. Voice and data information received by wireless circuitry 508 (e.g., in speech recognition or voice command applications) is sent to one or more processors 518 via peripherals interface 516. One or more processors 518 are configurable to process various data formats for one or more application programs 534 stored on medium 502.

Peripherals interface 516 couple the input and output peripherals of device 500 to the one or more processors 518 and computer-readable medium 502. One or more processors 518 communicate with computer-readable medium 502 via a controller 520. Computer-readable medium 502 can be any device or medium that can store code and/or data for use by one or more processors 518. Computer-readable medium 502 can include a memory hierarchy, including cache, main memory and secondary memory. The memory hierarchy can be implemented using any combination of random access memory (RAM) (e.g., static random access memory (SRAM,) dynamic random access memory (DRAM), double data random access memory (DDRAM)), read only memory (ROM), FLASH, magnetic and/or optical storage devices, such as disk drives, magnetic tape, CDs (compact disks) and DVDs (digital video discs). In some embodiments, peripherals interface 516, one or more processors 518, and controller 520 can be implemented on a single chip, such as processing system 504. In some other embodiments, they can be implemented on separate chips.

Processor(s) 518 can include hardware and/or software elements that perform one or more processing functions, such as mathematical operations, logical operations, data manipulation operations, data transfer operations, controlling the reception of user input, controlling output of information to users, or the like. Processor(s) 518 can be embodied as one or more hardware processors, microprocessors, microcontrollers, field programmable gate arrays (FPGAs), application-specified integrated circuits (ASICs), or the like.

Device 500 also includes a power system 542 for powering the various hardware components. Power system 542 can include a power management system, one or more power sources (e.g., battery, alternating current (AC)), a recharging system, a power failure detection circuit, a power converter or inverter, a power status indicator (e.g., a light emitting diode (LED)) and any other components typically associated with the generation, management and distribution of power in mobile devices.

In some embodiments, device 500 can include a camera 544. In some embodiments, device 500 includes sensors 546. Sensors can include temperature sensors, accelerometers, compass, gyrometer, pressure sensors, audio sensors, light sensors, barometers, and the like. Sensors 546 can be used to sense location aspects, such as auditory or light signatures of a location.

In some embodiments, device 500 can include a backlight 548 used to project light to illuminate the liquid crystal display.

One or more processors 518 run various software components stored in medium 502 to perform various functions for device 500. In some embodiments, the software components include an operating system 522, a grey scale module 524, a timing module 526, a dynamic waveform module 528 and various applications 534.

Operating system 522 can be any suitable operating system, including iOS, Mac OS, Darwin, Real Time Operating System (RTXC), LINUX, UNIX, OS X, WINDOWS, or an embedded operating system such as VxWorks. The operating system can include various procedures, sets of instructions, software components and/or drivers for controlling and managing general system tasks (e.g., memory management, storage device control, power management, etc.) and facilitates communication between various hardware and software components.

Grey Scale Module 524 uses one or more fast photo detectors to determine the grey scale of various regions of images to be displayed.

The timing module 526 can detect the driving frequency for the voltage-holding ratio of the display. The timing module 526 can synchronize the backlight waveform with the display waveform.

Dynamic Waveform Module 528 can generate a backlight waveform that compensates for the drop in voltage holding ratio for various types of liquid crystal displays.

The one or more applications 534 on device 500 can include any applications installed on the device 500, including without limitation, a browser, address book, contact list, email, instant messaging, social networking, word processing, keyboard emulation, widgets, JAVA-enabled applications, encryption, digital rights management, voice recognition, voice replication, a music player (which plays back recorded music stored in one or more files, such as MP3 or AAC files), etc.

There may be other modules or sets of instructions (not shown), such as a graphics module, a time module, etc. For example, the graphics module can include various conventional software components for rendering, animating and displaying graphical objects (including without limitation text, web pages, icons, digital images, animations and the like) on a display surface. In another example, a timer module can be a software timer. The timer module can also be implemented in hardware. The time module can maintain various timers for any number of events.

I/O subsystem 506 can be coupled to a display system (not shown), which can be a touch-sensitive display. The display displays visual output to the user in a GUI. The visual output can include text, graphics, video, and any combination thereof. Some or all of the visual output can correspond to user-interface objects. A display can use light emitting diode (LED), liquid crystal display (LCD) technology, or light emitting polymer display (LPD) technology, although other display technologies can be used in other embodiments.

In some embodiments, I/O subsystem 506 can include a display and user input devices such as a keyboard, mouse, and/or trackpad. In some embodiments, I/O subsystem 506 can include a touch-sensitive display. A touch-sensitive display can also accept input from the user based at least part on haptic and/or tactile contact. In some embodiments, a touch-sensitive display forms a touch-sensitive surface that accepts user input. The touch-sensitive display/surface (along with any associated modules and/or sets of instructions in computer-readable medium 502) detects contact (and any movement or release of the contact) on the touch-sensitive display and converts the detected contact into interaction with user-interface objects, such as one or more soft keys, that are displayed on the touch screen when the contact occurs. In some embodiments, a point of contact between the touch-sensitive display and the user corresponds to one or more digits of the user. The user can make contact with the touch-sensitive display using any suitable object or appendage, such as a stylus, pen, finger, and so forth. A touch-sensitive display surface can detect contact and any movement or release thereof using any suitable touch sensitivity technologies, including capacitive, resistive, infrared, and surface acoustic wave technologies, as well as other proximity sensor arrays or other elements for determining one or more points of contact with the touch-sensitive display.

Further, I/O subsystem 506 can be coupled to one or more other physical control devices (not shown), such as push-buttons, keys, switches, rocker buttons, dials, slider switches, sticks, LEDs, etc., for controlling or performing various functions, such as power control, speaker volume control, ring tone loudness, keyboard input, scrolling, hold, menu, screen lock, clearing and ending communications and the like. In some embodiments, in addition to the touch screen, device 500 can include a touchpad (not shown) for activating or deactivating particular functions. In some embodiments, the touchpad is a touch-sensitive area of the device that, unlike the touch screen, does not display visual output. The touchpad can be a touch-sensitive surface that is separate from the touch-sensitive display or an extension of the touch-sensitive surface formed by the touch-sensitive display.

In some embodiments, some or all of the operations described herein can be performed using an application executing on the user's device. Circuits, logic modules, processors, and/or other components may be configured to perform various operations described herein. Those skilled in the art will appreciate that, depending on implementation, such configuration can be accomplished through design, setup, interconnection, and/or programming of the particular components and that, again depending on implementation, a configured component might or might not be reconfigurable for a different operation. For example, a programmable processor can be configured by providing suitable executable code; a dedicated logic circuit can be configured by suitably connecting logic gates and other circuit elements; and so on.

Any of the software components or functions described in this application may be implemented as software code to be executed by a processor using any suitable computer language such as, for example, Java, C, C++, C#, Objective-C, Swift, or scripting language such as Perl or Python using, for example, conventional or object-oriented techniques. The software code may be stored as a series of instructions or commands on a computer readable medium for storage and/or transmission. A suitable non-transitory computer readable medium can include random access memory (RAM), a read only memory (ROM), a magnetic medium such as a hard-drive or a floppy disk, or an optical medium, such as a compact disk (CD) or DVD (digital versatile disk), flash memory, and the like. The computer readable medium may be any combination of such storage or transmission devices.

Computer programs incorporating various features of the present disclosure may be encoded on various computer readable storage media; suitable media include magnetic disk or tape, optical storage media, such as compact disk (CD) or DVD (digital versatile disk), flash memory, and the like. Computer readable storage media encoded with the program code may be packaged with a compatible device or provided separately from other devices. In addition, program code may be encoded and transmitted via wired optical, and/or wireless networks conforming to a variety of protocols, including the Internet, thereby allowing distribution, e.g., via Internet download. Any such computer readable medium may reside on or within a single computer product (e.g. a solid state drive, a hard drive, a CD, or an entire computer system), and may be present on or within different computer products within a system or network. A computer system may include a monitor, printer, or other suitable display for providing any of the results mentioned herein to a user.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

Although the present disclosure has been described with respect to specific embodiments, it will be appreciated that the disclosure is intended to cover all modifications and equivalents within the scope of the following claims.

All patents, patent applications, publications, and descriptions mentioned herein are incorporated by reference in their entirety for all purposes. None is admitted to be prior art.

The specification and drawings are, accordingly, to be regarded in an illustrative rather than a restrictive sense. It will, however, be evident that various modifications and changes may be made thereunto without departing from the broader spirit and scope of the disclosure as set forth in the claims.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the disclosure to the specific form or forms disclosed, but on the contrary, the intention is to cover all modifications, alternative constructions and equivalents falling within the spirit and scope of the disclosure, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. The phrase "based on" should be understood to be open-ended, and not limiting in any way, and is intended to be interpreted or otherwise read as "based at least in part on," where appropriate. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the disclosure and does not pose a limitation on the scope of the disclosure unless otherwise claimed. No language in the specification should be construed as indicating any non-claimed element as essential to the practice of the disclosure. The use of "or" is intended to mean an "inclusive or," and not an "exclusive or" unless specifically indicated to the contrary. Reference to a "first" component does not necessarily require that a second component be provided. Moreover reference to a "first" or a "second" component does not limit the referenced component to a particular location unless expressly stated. The term "based on" is intended to mean "based at least in part on."

Disjunctive language such as the phrase "at least one of X, Y, or Z," unless specifically stated otherwise, is otherwise understood within the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present. Additionally, conjunctive language such as the phrase "at least one of X, Y, and Z," unless specifically stated otherwise, should also be understood to mean X, Y, Z, or any combination thereof, including "X, Y, and/or Z."

What is claimed is:

1. A method of compensating for flicker in a liquid crystal display performed by one or more processors for a poor flicker liquid crystal display, the method comprising:

detecting operation of the liquid crystal display at a driving rate in a low frequency range, the operation in the low frequency range resulting in flicker of one or more images of the liquid crystal display;

generating a dynamic waveform for a backlight of the liquid crystal display to compensate for the flicker for the liquid crystal display, the dynamic waveform varying illumination level of the backlight for the liquid crystal display by a predetermined luminosity at a predetermined frequency;

detecting a grey level of one or more frames of an image received from a video source;

calculating an average grey level of the one or more frames of an image; and accessing a table stored in a memory of the liquid crystal display to determine the predetermined luminosity of the dynamic waveform based at least in part on the calculated average grey level of the one or more frames of the image from the video source;

synchronizing a timing of the dynamic waveform for the backlight and the driving rate of the liquid crystal display such that the dynamic waveform for the backlight and the driving rate of the liquid crystal display start simultaneously; and illuminating the backlight according to the dynamic waveform in synch with the driving rate of the liquid crystal display.

2. The method of claim 1, further comprising:

detecting a grey level of a portion of one or more frames of an image received from a video source;

calculating an average grey level of the portion of the one or more frames of an image; and accessing a table stored in a memory of the liquid crystal display to determine the predetermined luminosity of the dynamic waveform based at least in part on the calculated average grey level of the portion of the one or more frames of the image from a video source.

3. The method of claim 1, further comprising:

measuring a temperature of the liquid crystal display; and accessing a table stored in a memory of the liquid crystal display to determine the predetermined luminosity of the dynamic waveform based at least in part on the measured temperature of the liquid crystal display.

4. The method of claim 1, wherein the low frequency range is between 0.01 and 59.9 Hertz.

5. The method of claim 1, wherein the predetermined frequency is over 120 Hertz.

6. The method of claim 1, wherein the one or more processors of the liquid crystal display receive a synchronization signal from a display driver.

7. A poor flicker liquid crystal display, comprising:

a programmable backlight capable of varying luminosity of the backlight based at least in part on a timing signal;

a memory to store one or more instructions; and one or more processors to perform operations comprising:

detecting operation of the liquid crystal display at a driving rate in a low frequency range, the operation in the low frequency range resulting in flicker of one or more images of the liquid crystal display;

generating a dynamic waveform for a backlight of the liquid crystal display to compensate for the flicker for the liquid crystal display, the dynamic waveform varying illumination level of the backlight for the liquid crystal display by a predetermined luminosity at a predetermined frequency;

detecting a grey level of one or more frames of an image received from a video source;

calculating an average grey level of the one or more frames of an image; and accessing a table stored in a memory of the liquid crystal display to determine the predetermined luminosity of the dynamic waveform based at least in part on the calculated average grey level of the one or more frames of the image from the video source;

synchronizing a timing of the dynamic waveform for the backlight and the driving rate of the liquid crystal display such that the dynamic waveform for the backlight and the driving rate of the liquid crystal display start simultaneously; and illuminating the backlight according to the dynamic waveform in synch with the driving rate of the liquid crystal display.

8. The poor flicker liquid crystal display of claim 7, the operations further comprising:

detecting a grey level of a portion of one or more frames of an image received from a video source;

calculating an average grey level of the portion of the one or more frames of an image; and accessing a table stored in a memory of the liquid crystal display to determine the predetermined luminosity of the dynamic waveform based at least in part on the calculated average grey level of the portion of the one or more frames of the image from a video source.

9. The poor flicker liquid crystal display of claim 7, the operations further comprising:

measuring a temperature of the liquid crystal display; and accessing a table stored in a memory of the liquid crystal display to determine the predetermined luminosity of the dynamic waveform based at least in part on the measured temperature of the liquid crystal display.

10. The liquid crystal display of claim 7, wherein the low frequency range is between 0.01 and 59.9 Hertz.

11. The liquid crystal display of claim 7, wherein the predetermined frequency is over 120 Hertz.

12. The liquid crystal display of claim 7, wherein the one or more processors of the liquid crystal display receive a synchronization signal from a display driver.

13. A non-transitory computer-readable storage medium, including instructions configured to cause one or more processors of a display to perform operations comprising:

detecting operation of a liquid crystal display at a driving rate in a low frequency range, the operation in the low frequency range resulting in flicker of one or more images of the liquid crystal display;

generating a dynamic waveform for a backlight of the liquid crystal display to compensate for the flicker for the liquid crystal display, the dynamic waveform varying illumination level of the backlight for the liquid crystal display by a predetermined luminosity at a predetermined frequency;

detecting a grey level of one or more frames of an image received from a video source;

calculating an average grey level of the one or more frames of an image; and accessing a table stored in a memory of the liquid crystal display to determine the predetermined luminosity of the dynamic waveform based at least in part on the calculated average grey level of the one or more frames of the image from the video source;

synchronizing a timing of the dynamic waveform for the backlight and the driving rate of the liquid crystal display such that the dynamic waveform for the backlight and the driving rate of the liquid crystal display start simultaneously; and illuminating the backlight according to the dynamic waveform in synch with the driving rate of the liquid crystal display.

14. The non-transitory computer-readable medium of claim 13, including instructions configured to cause one or more processors of a display to perform operations further comprising:

detecting a grey level of a portion of one or more frames of an image received from a video source;

calculating an average grey level of the portion of the one or more frames of an image; and accessing a table stored in a memory of the liquid crystal display to determine the predetermined luminosity of the dynamic waveform based at least in part on the calculated average grey level of the portion of the one or more frames of the image from a video source.

15. The non-transitory computer-readable medium of claim 13, including instructions configured to cause one or more processors of a display to perform operations further comprising:

measuring a temperature of the liquid crystal display; and accessing a table stored in a memory of the liquid crystal display to determine the predetermined luminosity of the dynamic waveform based at least in part on the measured temperature of the liquid crystal display.

16. The non-transitory computer-readable medium of claim 13, wherein the low frequency range is between 0.01 and 59.9 Hertz.

17. The non-transitory computer-readable medium of claim 13, wherein the predetermined frequency is over 120 Hertz.

* * * * *